US008498422B2

(12) United States Patent
Oomen et al.

(10) Patent No.: US 8,498,422 B2
(45) Date of Patent: Jul. 30, 2013

(54) PARAMETRIC MULTI-CHANNEL AUDIO REPRESENTATION

(75) Inventors: Arnoldus Werner Johannes Oomen, Eindhoven (NL); Erik Gosuinus Petrus Schuijers, Eindhoven (NL); Dirk Jeroen Breebaart, Eindhoven (NL); Steven Leonardus Josephus Dimphina Elisabeth Van De Par, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 2129 days.

(21) Appl. No.: 10/511,806

(22) PCT Filed: Apr. 22, 2003

(86) PCT No.: PCT/IB03/01591

§ 371 (c)(1),
(2), (4) Date: Oct. 19, 2004

(87) PCT Pub. No.: WO03/090207

PCT Pub. Date: Oct. 30, 2003

(65) Prior Publication Data

US 2005/0226426 A1 Oct. 13, 2005

(30) Foreign Application Priority Data

Apr. 22, 2002 (EP) ..... 02076588
Jul. 16, 2002 (EP) ..... 02077869

(51) Int. Cl.
*H04R 5/00* (2006.01)

(52) U.S. Cl.
USPC ..... 381/23; 381/17; 704/500; 704/501; 704/E19.01; 704/E19.044; 704/E19.048

(58) Field of Classification Search
USPC ..... 381/2, 17, 1, 19–23; 700/94; 704/500, 704/503, 200, 229, 501, 504, 205, 208, 200.1, 704/204, E19.01, E19.044, E19.048
See application file for complete search history.

(56) References Cited

U.S. PATENT DOCUMENTS 5,701,346 A * 12/1997 Herre et al. ..... 381/18
5,812,971 A * 9/1998 Herre ..... 704/230

(Continued)

FOREIGN PATENT DOCUMENTS

EP 1107232 A2 6/2001
JP 9274500 A 10/1997

OTHER PUBLICATIONS

R. G. Van Der Waal et al; Subband Coding of Sterophonic Digital Audio Signals Speech Processing 2, VLSI, Underwater Signal Processing, Toronto, May 14-17, 1991, International Conference on Acoustics, Speech & Signal Processing, ICASSP, NY, vol. 2, Conf. 16, Apr. 14, 1991; pp. 3601-3604; XP010043648.
Bosi et al: "ISO/IEC MPEG-2 Advanced Audio Coding"; Journal of Audio Engineering Society, vol. 45, No. 10, Oct. 1997, pp. 789-812.

(Continued)

*Primary Examiner* — Disler Paul

(57) ABSTRACT

Multi-channel audio signals are coded into a monaural audio signal and information allowing to recover the multi-channel audio signal from the monaural audio signal and the information. The information is generated by determining a first portion of the information for a first frequency region of the multi-channel audio signal, and by determining a second portion of the information for a second frequency region of the multi-channel audio signal. The second frequency region is a portion of the first frequency region and thus is a subrange of the first frequency region. The information is multi-layered enabling a scaling of the decoding quality versus bit rate.

16 Claims, 3 Drawing Sheets

U.S. PATENT DOCUMENTS

| | | | | |
|---|---|---|---|---|
| 5,890,125 | A * | 3/1999 | Davis et al. | 704/501 |
| 6,021,386 | A * | 2/2000 | Davis et al. | 704/229 |
| 6,108,626 | A * | 8/2000 | Cellario et al. | 704/230 |
| 7,269,550 | B2 * | 9/2007 | Tsushima et al. | 704/205 |
| 7,382,886 | B2 * | 6/2008 | Henn et al. | 381/23 |
| 2003/0088423 | A1 * | 5/2003 | Nishio et al. | 704/500 |
| 2003/0115051 | A1 * | 6/2003 | Chen et al. | 704/230 |
| 2004/0204936 | A1 * | 10/2004 | Jensen et al. | 704/230 |

OTHER PUBLICATIONS

Faller et al: "Efficient Representation of Spatial Audio Using Perceptual Parametrization"; IEEE Worshop on the Applications of Signal Processing to Audio and Acoustics, 2001, pp. 199-202.

Faller et al: "Binaural Cue Coding Applied to Stereo and Multi-Channel Audio Compression"; Audio Engineering Society, 112 Convention, May 2002, Munich, Germany.

* cited by examiner

PARAMETRIC MULTI-CHANNEL AUDIO REPRESENTATION

The invention relates to a method of encoding a multi-channel audio signal, an encoder for encoding a multi-channel audio signal, an apparatus for supplying an audio signal, an encoded audio signal, a storage medium on which the encoded audio signal is stored, a method of decoding an encoded audio signal, a decoder for decoding an encoded audio signal, and an apparatus for supplying a decoded audio signal.

EP-A-1107232 discloses a parametric coding scheme to generate a representation of a stereo audio signal which is composed of a left channel signal and a right channel signal. To efficiently utilize transmission bandwidth, such a representation contains information concerning only a monaural signal which is either the left channel signal or the right channel signal, and parametric information. The other stereo signal can be recovered based on the monaural signal together with the parametric information. The parametric information comprises localization cues of the stereo audio signal, including intensity and phase characteristics of the left and the right channel.

It is an object of the invention to provide a parametric multi-channel audio system which is able to scale the quality of the encoded audio signal with the available bit rate or to scale the quality of the decoded audio signal with the complexity of the decoder or the available transmission bandwidth.

A first aspect of the invention provides a method of encoding a multi-channel audio signal. A second aspect of the invention provides a further method of encoding a multi-channel audio signal. A third aspect of the invention provides an encoder for encoding a multi-channel audio signal. A fourth aspect of the invention provides a further encoder for encoding a multi-channel audio signal. A fifth aspect of the invention provides an apparatus for supplying an audio signal. A sixth aspect of the invention provides an encoded audio signal. A seventh aspect of the invention provides a storage medium on which the encoded signal is stored. An eight aspect of the invention provides a method of decoding. A ninth aspect of the invention provides a decoder for decoding an encoded audio signal. A tenth aspect of the invention provides an apparatus for supplying a decoded audio signal.

In the method of encoding a multi-channel audio signal in accordance with the first aspect of the invention, a single channel audio signal is generated. Further, information is generated from the multi-channel audio signal allowing recovering, with a required quality level, the multi-channel audio signal from the single channel audio signal and the information. Preferably, the information comprises sets of parameters, for example, as known from EP-A-1107232.

In accordance with the first aspect of the invention, the information is generated by determining a first portion of the information for a first frequency region of the multi-channel audio signal, and by determining a second portion of the information for a second frequency region of the multi-channel audio signal. The second frequency region is a portion of the first frequency region and thus is a sub-range of the first frequency region. Now, two levels of quality of decoding are possible. For a low quality level of the decoded multi-channel audio signal, the decoder uses the encoded single channel audio signal, and the first portion of the information. For a higher quality level, the decoder uses the encoded single channel audio signal, and both the first and the second portion of the information. Of course, it is possible to select the decoding quality out of a multitude of levels if a multitude of portions of information each being associated with a different frequency region are present. For example, the first portion may comprise a single set of parameters determined within a frequency region which covers the full bandwidth of the multi-channel audio signal. And the second portion may comprise several sets of parameters, each set of parameters being determined for a sub-range or portion of the full bandwidth. Together, the portions preferably cover the full bandwidth. But many other possibilities exist. For example, the first portion may comprise two sets of parameters, the first set being determined for a frequency region which covers a lower part of the full bandwidth, and the second set being determined for a frequency region covering the other part of the full bandwidth. The second portion may comprise two sets of parameters determined for two frequency regions within the lower part of the full bandwidth. It is not required that the number of sets of parameters for the lower part and the higher part of the full bandwidth are equal.

This representation of the encoded audio signal allows a quality of the decoded audio signal to depend on the complexity of the decoder. For example, in a simple portable decoder a low complexity decoder may be used which has a low power consumption and which is therefore able to use only part of the information. In a high end application, a complex decoder is used which uses all the information available in the coded signal.

The quality of the decoded audio can also depend on the available transmission bandwidth. If the transmission bandwidth is high the decoder can decode all available layers, since they are all transmitted. If the transmission bandwidth is low the transmitter can decide to only transmit a limited number of layers.

In a second aspect of the invention, the encoder receives a maximum allowable bit rate of the encoded multi-channel audio signal. This maximum allowable bit rate may be defined by the available bit rate of a transmission channel such as Internet, or of a storage medium. In applications wherein the transmission bandwidth is variable and thus the maximum allowable bit rate changes in time, it is important to be able to adapt to these fluctuations of the transmission bandwidth to prevent a very low quality of the decoded audio signal. Normally, the encoder encodes all available layers. It is decided at the transmitting-end what layers to transmit, depending on the available channel capacity. It is possible to do this with the encoder in the loop, but this is more complicated that just stripping some layers prior to transmission.

The encoder only adds the second portion of the information for the second frequency region of the multi-channel audio signal to the encoded audio signal if a bit rate of the encoded multi-channel audio signal which comprises the single channel audio signal, and the first and second portion of the information is not higher than the maximum allowable bit rate. Thus, the second portion is not present in the coded audio signal if the transmission bandwidth is not large enough to support the transmission of the second portion.

In an embodiment of the invention, the information comprises sets of parameters, each one of the portions of the information is represented by one or more sets of parameters. The number of sets of parameters depending on the number of frequency regions present in the portions of the information.

In an embodiment of the invention, the sets of parameters comprise at least one of the localization cues.

In an embodiment of the invention, the first frequency region substantially covers the full bandwidth of the multi-channel audio signal. In this way, one set of parameters suffices to provide the basic information required to decode the single channel audio signal into the multi-channel audio signal. In this way a basic level of quality of the decoded audio signal is guaranteed. The second frequency range covers part of the full bandwidth. In this way, the second portion when present in the coded audio signal improves the quality of the decoded audio signal in this frequency range.

In an embodiment of the invention, the second portion of the information comprises at least two frequency ranges which together substantially cover the full bandwidth of the multi-channel audio signal. In this way, the quality improvement provided by the second portion is present over the complete bandwidth.

In an embodiment of the invention, the base layer which comprises the single channel audio signal and the first portion of the information is always present in the encoded audio signal. The enhancement layer which comprises the second portion of the information is encoded only if the bit rate of the encoded audio signal does not exceed the maximally allowable bit rate. In this way, the quality of the decoded audio signal will depend on the maximally allowable bit rate. If the maximally allowable bit rate is too low to accommodate the enhancement layer, the decoded audio signal will be obtained from the base layer which will produce a better quality of the decoded audio than will be the case if unpredictable parts of the coded audio will not reach the decoder.

In further embodiments of the invention, the portions of the information (usually containing sets of parameters, one set for each frequency band represented) in a next frame are coded based on the parameters of the previous frame. Usually, this reduces the bit rate of the encoded portions of the information, because, due to correlation, the information in two successive frames will not differ substantially.

In further embodiments of the invention, the difference of the parameters of two successive frames is coded instead of the parameters itself.

Prior solutions in audio coders that have been suggested to reduce the bit rate of stereo program material include intensity stereo and M/S stereo.

In the intensity stereo algorithm, high frequencies (typically above 5 kHz) are represented by a single audio signal (i.e., mono) combined with time-varying and frequency-dependent scale factors or intensity factors which allow to recover an decoded audio signal which resembles the original stereo signal for these frequency regions. In the M/S algorithm, the signal is decomposed into a sum (or mid, or common) signal and a difference (or side, or uncommon) signal. This decomposition is sometimes combined with principle component analysis or time-varying scale factors. These signals are then coded independently, either by a transform coder or sub-band coder [which are both waveform coders]. The amount of information reduction achieved by this algorithm strongly depends on the spatial properties of the source signal. For example, if the source signal is monaural, the difference signal is zero and can be discarded. However, if the correlation of the left and right audio signals is low (which is often the case for the higher frequency regions), this scheme offers only little bit rate reduction. For the lower frequency regions M/S coding generally provides significant merit.

Parametric descriptions of audio signals have gained interest during the last years, especially in the field of audio coding. It has been shown that transmitting (quantized) parameters that describe audio signals requires only little transmission capacity to re-synthesize a perceptually equal signal at the receiving end. However, current parametric audio coders focus on coding monaural signals, and stereo signals are processed as dual mono signals.

These and other aspects of the invention are apparent from and will be elucidated with reference to the embodiments described hereinafter.

Figure 4:
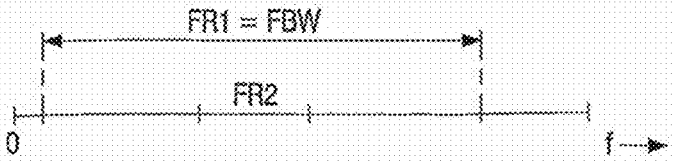
Figure 5:
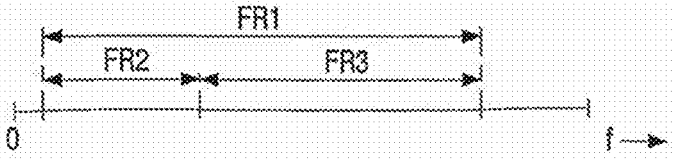
Figure 6:
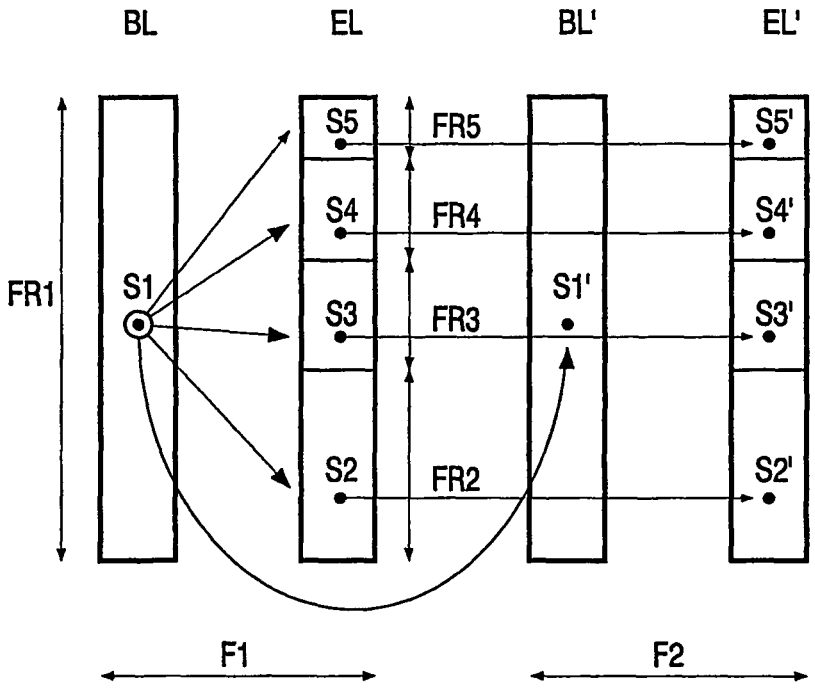
Figure 7:
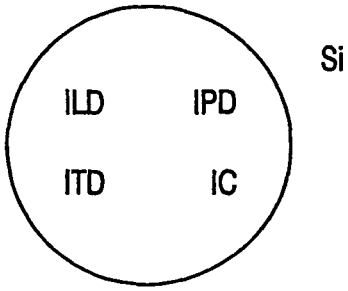
Figure 8:
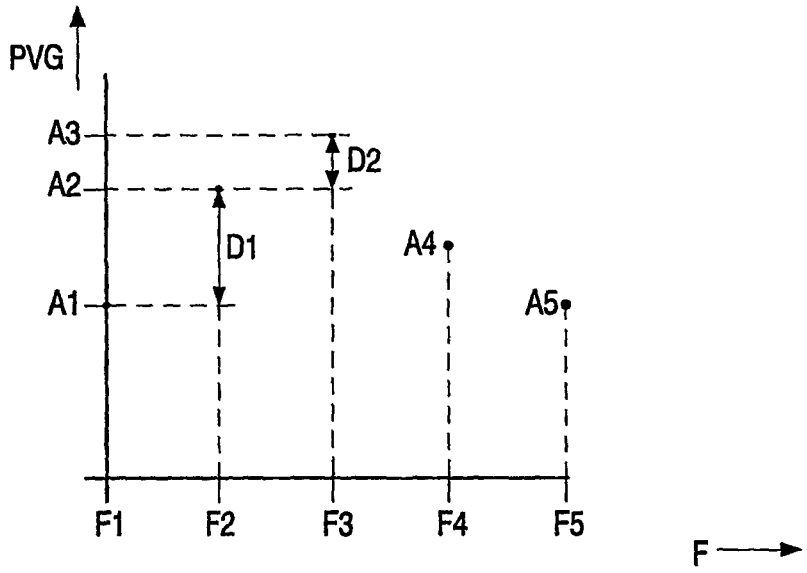
Figure 9:
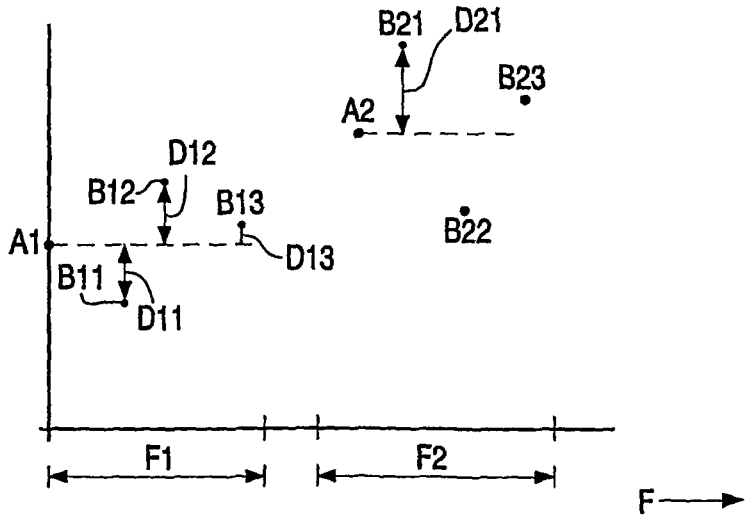

FIG. 4 shows an embodiment of the frequency ranges in accordance with the invention, FIG. 5 shows another embodiment of the frequency ranges in accordance with the invention, FIG. 6 shows the determination of the sets of parameters based on parameters in a previous frame in accordance with an embodiment of the invention, FIG. 7 shows a set of parameters, FIG. 8 shows the differential determination of the parameters of the base layer, and FIG. 9 shows the differential determination of the parameters corresponding to a frequency region of an enhancement layer.

Figure 1:
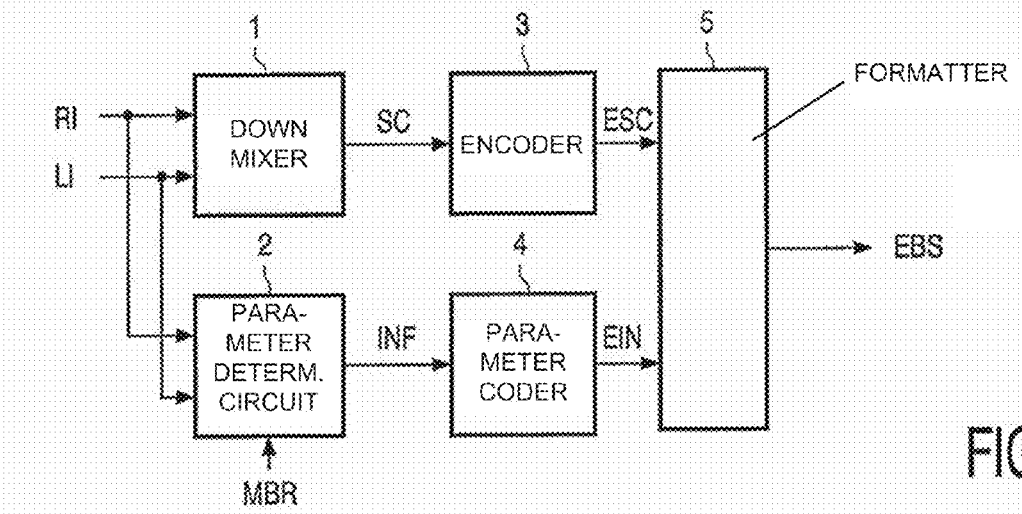
FIG. 1 shows a block diagram of a multi-channel encoder for stereo audio.

FIG. 1 shows a block diagram of a multi-channel encoder. The encoder receives a multi-channel audio signal which is shown as a stereo signal RI, LI and the encoder supplies the encoded multi-channel audio signal EBS.

The down mixer 1 combines the stereo signal or stereo channels RI, LI into a single channel audio signal (also referred to as monaural signal) SC. For example, the down mixer 1 may determine the average of the input audio signals RI, LI.

The encoder 3 encodes the monaural signal SC to obtain an encoded monaural signal ESC. The encoder 3 may be of a known kind, for example, an MPEG coder (MPEG-LII, MPEG-LIII (mp3), or MPEG2-AAC).

The parameter determining circuit 2 determines the sets of parameters S1, S2, . . . characterizing the information INF based on the input audio signals RI, LI. Optionally, the parameter determining circuit 2 receives the maximum allowable bit rate MBR to only determine the parameter sets S1, S2, . . . which when coded by the parameter coder 4, together with the encoded monaural signal ESC do not exceed the maximum allowable bit rate MBR. The encoded parameters are denoted by EIN.

The formatter 5 combines the encoded monaural signal SC and the encoded parameters EIN in a data stream in a desired format to obtain the encoded multi-channel audio signal EBS.

The operation of the encoder is elucidated in more detail in the now following, by way of example, with respect to an embodiment. The multi-channel audio signal LI, RI is encoded in a single monaural signal SC (further also referred to as single channel audio signal). The parameterization of spatial attributes of the multi-channel audio signals LI, RI is performed by the parameter determining circuit 2. The parameters contain information on how to restore the multi-channel audio signal LI, RI from the monaural signal SC. The parameters are usually encoded by the parameter encoder 4 before combining them with the encoded single monaural signal ESC. Thus, for general audio coding applications, these parameters combined with only one monaural audio signal are transmitted or stored. The combined coded signal is the encoded multi-channel audio signal EBS. The transmission or storage capacity necessary to transmit or store the encoded multi-channel audio signal EBS is strongly reduced compared to audio coders that process the multi-channels independently. Nevertheless, the original spatial impression is maintained by the information INF which contains the (sets of) parameters.

In particular, the parametric description of multi-channel audio RI, LI is related to a binaural processing model which aims at describing the effective signal processing of the binaural auditory system.

The model splits the incoming audio LI, RI into several band-limited signals, which, preferably, are spaced linearly at an ERB-rate scale. The bandwidth of these signals depends on the center frequency, following the ERB-rate. Subsequently, preferably, for every frequency band, the following properties of the incoming signals are analyzed:

- The interaural level difference, or ILD, defined by the relative levels of the band-limited signal stemming from the left and right ears,
- The interaural time (or phase) difference ITD (or IPD), defined by the interaural delay (or phase shift) corresponding to the peak in the interaural cross-correlation function, and
- The (dis)similarity of the waveforms that can not be accounted for by ITDs or ILDs, which can be parameterized by the maximum interaural cross-correlation IC (for example, the value of the cross-correlation at the position of the maximum peak).

The sets S1, S2, . . . of the three parameters, one set for each frequency band FR1, FR2, . . . , vary over time. However, since the binaural auditory system is very sluggish in its processing, the update rate of these properties is rather low (typically tens of milliseconds).

It may be assumed that the (slowly) time-varying parameters are the only spatial signal properties that the binaural auditory system has available, and that from these time and frequency dependent parameters, the perceived auditory world is reconstructed by higher levels of the auditory system.

Figure 2:
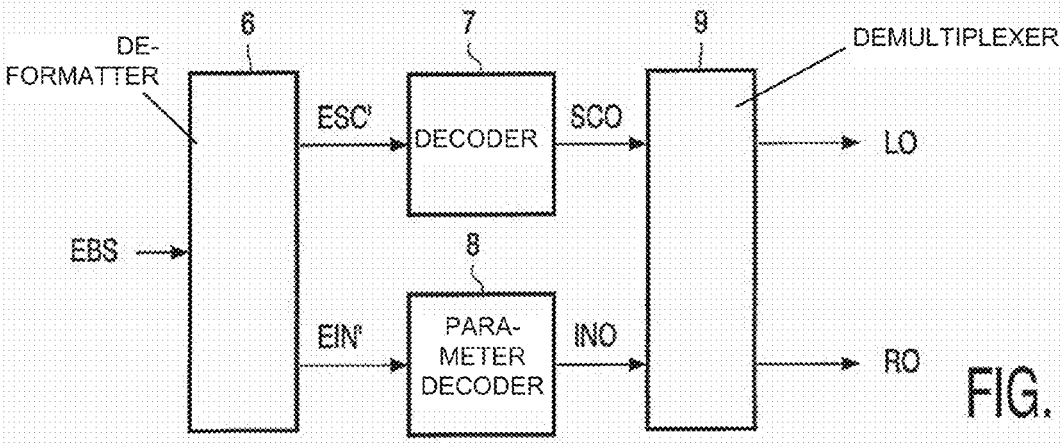
FIG. 2 shows a block diagram of a multi-channel decoder for stereo audio.

FIG. 2 shows a block diagram of a multi-channel decoder. The decoder receives the encoded multi-channel audio signal EBS and supplies the recovered decoded multi-channel audio signal which is shown as a stereo signal RO, LO.

The deformatter 6 retrieves the encoded monaural signal ESC' and the encoded parameters EIN' from the data stream EBS. The decoder 7 decodes the encoded monaural signal ESC' into the output monaural signal SCO. The decoder 7 may be of any known kind (of course matched to the encoder that has been used), for example, the decoder 7 is an MPEG decoder. The decoder 8 decodes the encoded parameters EIN' into output parameters INO.

The demultiplexer 9 recovers the output stereo audio signals LO and RO by applying the parameter sets S1, S2, . . . of the output parameters INO on the output monaural signal SCO.

Figure 3:
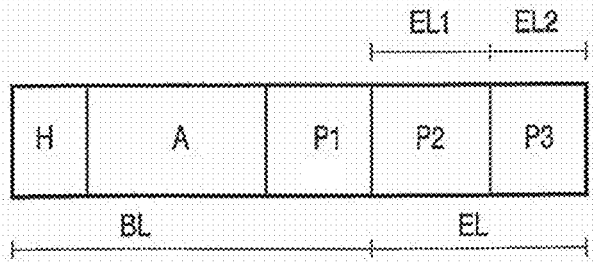
FIG. 3 shows a representation of the encoded data stream.

FIG. 3 shows a representation of the encoded data stream. For example, in each frame F1, F2, . . . , the data package starts with a header H followed by the coded monaural signal ECS now indicated by A, a first portion P1 of the encoded information EIN, a second portion P2 of the encoded information EIN, and a third portion P3 of the encoded information EIN.

If the frame F1, F2, . . . only comprises the header H and the coded monaural signal ECS, only the monaural signal SC is transmitted.

As disclosed in EP-A-1107232, the full frequency band in which the input audio signal occurs is divided into a plurality of sub-frequency bands, which together cover the full frequency band. In the terminology in accordance with the invention, the multi-channel information INF is encoded in a plurality of parameter sets S1, S2, . . . one set for each sub-frequency band FR1, FR2, . . . . This plurality of parameter sets S1, S2, . . . is coded in the first portion P1 of the encode information EIN. Thus, to transmit a basic level quality multi-channel audio signal, the bit stream comprises the header H, the portion A which is the coded monaural signal ECS and the first portion P1.

In the bit stream in accordance with an embodiment of the invention, the first portion P1 consists of a single set parameters S1, only. The single set being determined for the full bandwidth FR1. This bit stream which comprises the header H and the portions A and P1 provides a basic layer of quality, indicated by BL in FIG. 3.

To support an enhanced quality, further portions P2, P3 of the coded information EIN are present in the bit stream. These further portions form an enhancement layer EL. The bit stream may comprise a single further portion P2 or more than 1 further portion. The further portion P2 preferably comprises a plurality of sets S2, S3, . . . of parameters, one set for each sub-frequency band FR2, FR3, . . . , the sub-frequency bands FR2, FR3, . . . preferably covering the full frequency band FR1. The enhanced quality may also be present in a step-wise manner, a first enhancement level is provided by the enhancement layer EL1 which comprises the first portion. And a second enhancement layer EL comprises the first enhancement layer EL1 and the second enhancement layer EL2 which comprises the portion P3.

The further portion P2 may also comprise a single set S2 of parameters corresponding to a single frequency band FR2 which is a sub-band of the full frequency band FR1. The further portion P2 may also comprise a number of sets of parameters S2, S3, . . . which correspond to frequency bands FR2, FR3, . . . which together do not cover the complete full frequency band FR1.

The further portion P3 preferably contains parameter sets for frequency bands which sub-divide at least one of the sub-bands of the further portion P2.

This format of the bit stream in accordance with the invention allows at the transmission channel, or at the decoder to scale the quality of the decoded audio signal with the bit rate of the transmission channel, or the decoding complexity of the decoder. For example, if the audio decoder should have a low power consumption, as is important in portable applications, the decoder may have a low complexity and only uses the portions H, A and P1. It would even be possible that the decoder is able to perform more complex operations at a higher power consumption if the user indicates that he desires a higher quality of the decoded audio.

It is also possible that the encoder is aware of the maximum allowable bit rate MBR which may be transmitted via the transmission channel or which may be stored on a storage medium. Now, the encoder is able to decide on how many, if any, further portions P1, P2, . . . fit within the maximum allowable bit rate MBR. The encoder codes only these allowable portions P1, P2, . . . in the bit stream.

FIG. 4 shows an embodiment of the frequency ranges in accordance with the invention. In this embodiment, the frequency band FR1 is equal to the full bandwidth FBW of the multi-channel audio signal LI, RI, and the frequency band FR2 is a sub-frequency band of the full bandwidth FBW.

If these are the only frequency ranges for which parameter sets S1, S2, . . . are determined, a single parameter set S1 is determined for the frequency band FR1 and is present in the portion P1, and a single parameter set S2 is determined for the frequency band FR2 and is present in the portion P2. The quality scaling is possible by either using or not using the portion P2.

FIG. 5 shows another embodiment of the frequency ranges in accordance with the invention. In this embodiment, the frequency band FR1 is again equal to the full bandwidth FBW, and the sub-frequency bands FR2 and FR3 together cover the full bandwidth FBW. Or said in other words, the frequency band FR1 is subdivided into the sub-frequency bands FR2 and FR3.

If these are the only frequency ranges for which parameter sets S1, S2, . . . are determined, the portion P1 comprises a single parameter set S1 determined for de frequency band FR1, and the portion P2 comprises two parameter sets S2 and S3 determined for the frequency band FR2 and FR3, respectively. The quality scaling is possible by either using or not using the portion P2.

FIG. 6 shows the determination of the sets of parameters based on parameters in a previous frame in accordance with an embodiment of the invention.

FIG. 6 shows a data stream which comprises in each frame F1, F2, . . . the coded information EIN which comprises the portion P1 which is part of the base layer BL and the portion P2 which forms the enhancement layer EL.

In the frame F1, the portion P1 comprises a single set of parameters S1 which are determined for the full bandwidth FR1. The portion P2, by way of example, comprises four sets of parameters S2, S3, S4, S5 which are determined for the sub-frequency bands FR2, FR3, FR4, FR5, respectively. The four sub-frequency bands FR2, FR3, FR4, FR5 sub-divide the frequency band FR1.

In the frame F2 which succeeds the frame F1, the portion P1 comprises a single set of parameters S1' which are determined for the full bandwidth FR1 and are part of the base layer BL'. The portion P2 comprises four sets of parameters S2', S3', S4', S5' which are again determined for the sub-frequency bands FR2, FR3, FR4, FR5, respectively and which form the enhancement layer EL'.

It is possible to code each of the sets of parameters S1, S2, . . . for each one of the frames F1, F2, . . . separately. It is also possible to code the sets of parameters of the portion P2 with respect to the parameters of the portion P1. This is indicated by the arrows starting at S1 and ending at S2 to S5 in the frame F1. Of course this is also possible in the other frames F2, . . . (not shown). In the same manner, it is possible to code the set of parameters S1' with respect to S1. And finally, the sets of parameters S2', S3', S4', S5' may be coded with respect to the sets of parameters S2, S3, S4, S5.

In this manner, the bit rate of the encoded information EIN can be reduced as the redundancy or correlation between sets of parameters S1 is used.

Preferably, the new parameters of the new sets of parameters S1', S2', S3', S4', S5' are coded as the difference of their value and the value of the parameters of the previous sets of parameters S1, S2, S3, S4, S5.

At regular time intervals, at least the parameter set S1 has to be coded absolutely and not differential to prevent errors to propagate too long.

FIG. 7 shows a set of parameters. Each set of parameters S1 may comprise one or more parameters. Usually the parameters are localization cues which provide information about the localization of sound objects in the audio information. Usually the localization cues are the interaural level difference ILD, the interaural time or phase difference ITD or IPD, and the interaural cross-correlation IC. More detailed information on these parameters is provided in the Audio Engineering Society Convention Paper 5574 "Binaural Cue Coding Applied to Stereo and Multi-channel Audio Compression" presented at the 112$^{th}$ Convention 2002 May 10-13 Munich, Germany, by Christof Faller et al.

FIG. 8 shows the differential determination of a parameter of the base layer. The horizontal axis indicates successive frames F1 to F5. The vertical axis shows the value PVG of a parameter of the set of parameters S1 of the base layer BL. This parameter has the values A1 to A5 for the frames F1 to F5 respectively. The contribution of this parameter to the bit rate of the coded information EIN will decrease if not the actual values A2 to A5 of the parameter are coded but the smaller differences D1, D2, . . . .

FIG. 9 shows the differential determination of the parameters corresponding to a frequency region of an enhancement layer. The horizontal axis indicates two successive frames F1 and F2. The vertical axis indicates the values of a particular parameter of the base layer BL and the enhancement layer EL. In this example, the base layer BL comprises the portion P1 of information INF with a single set of parameters determined for the full frequency range FBW, the particular parameter of the portion P1 has the value A1 for the frame F1 and A2 for the frame F2. The enhancement layer EL comprises the portion P2 of information INF with three sets of parameters determined for three respective frequency ranges FR2, FR3, FR4 which together fill the full frequency range FBW. The three particular parameters (for example, the parameter representing the ILD) have a value B11, B12, B13 in the frame F1 and a value B21, B22, B23 in the frame F2.

The contribution of these parameters to the bit rate of the coded information EIN will decrease if not the actual values B11 to B23 of the particular parameter are coded but the differences D11, D12, . . . , because these differences can be encoded more efficiently than the actual values.

To summarize, in a preferred embodiment in accordance with the invention, it is proposed to organize the stereo parameter information INF such that a base layer BL contains one set of parameters (preferably the time/level difference and the correlation) S1 which is determined for the full bandwidth FBW of the multi-channel audio signal LI, RI. The enhancement layer EL contains multiple sets of parameters S2, S3, . . . which correspond to subsequent frequency intervals FR2, FR3, . . . within the full bandwidth FBW. For bit-rate efficiency, the sets of parameters S2, S3, . . . in the enhancement layer EL can be differentially encoded with respect to the set of parameters S1 in the base layer BL.

The information INF is encoded in a multi-layered manner to enable a scaling of the decoding quality versus bit rate.

To conclude, in the now following, an preferred embodiment in accordance with the invention is elucidated with respect to program code and its elucidation.

First, for all subframes (the portions P1, P2, . . . ) in the frames F1, F2, . . . the data ESC for the monaural representation SC, the data EIN for the set of stereo parameters S1 for the full bandwidth FBW, and the stereo parameters S2, S3, . . . for the frequency bins (or regions) FR2, FR3, . . . is determined.

The program code is shown at the left hand side, and an elucidation of the program code is provided under description at the right hand side.

| code | description |
|---|---|
| { | |
| { | |
| for (f = 0; f < nrof_frames; f++) | for all frames do: |
| { | |
| example_mono_frame(f) | get data for monaural signal representation (the portion A in FIG. 3) |
| example_stereo_extension_layer_1(f) | get data stereo parameters full bandwidth (the portion P1) |

-continued

| code | description |
|---|---|
| example_stereo_extension_layer_2(f) | get data stereo parameters frequency bins (the portion P2) |
| } | |
| } | |

Secondly, depending on the value of the bit refresh_stereo the stereo parameters for the full bandwidth are coded absolutely (the actual value is coded) or the difference with previous values is coded. The following code is valid for the interaural level difference ILD.

| code | description |
|---|---|
| example_stereo_extension_layer_1(f) | |
| { | |
| refresh_stereo | 1 bit denoting whether or not data is to be absolutely coded or not |
| if (refresh_stereo == 1) | if data is to be coded absolutely |
| { | |
| ild_global[f] | code the actual interaural intensity difference(ild) for the whole frequency area (global) |
| } | |
| else | if not a refresh |
| { | |
| ild_global_diff[f] | code ild with respect to the previous frame |
| } | |
| } | |

Thirdly, depending on the value of the bit refresh_stereo the stereo parameters for all of the frequency bins are coded absolutely (the actual value is coded) or the difference with the corresponding parameters for the full bandwidth is coded. The following code is valid for the interaural level difference ILD.

| code | description |
|---|---|
| example_stereo_extension_layer_2(f) | |
| { | |
| if(refresh_stereo==1) | if refresh |
| { | |
| for(b=0; b<nrof_bins; b++) | for all frequency bins |
| { | |
| ild_bin[f, b] | code the ild in that bin relative to the global value |
| } | |
| } | |
| else | if no refresh |
| { | |
| for(b=0; b<nrof_bins; b++) | for all bins |
| { | |
| ild_bin_diff[f, b] | code the ild within a particular bin relative to the value in that bin in the previous frame |
| } | |
| } | |
| } | |

Wherein:

The term "refresh_stereo" is a flag denoting whether or not the stereo parameters should be refreshed (0=FALSE, 1=TRUE).

The term "ild_global[sf]" represents the Huffman encoded absolute representation level of the ILD for the whole frequency area for frame f.

The term "ild_global_diff[f]" represents the Huffman encoded relative representation level of the ILD for the whole frequency area for frame f.

The term "ild_bin[f, b]" represents the Huffman encoded absolute representation level of the ILD for frame f and bin b.

The term "ild_bin_diff[f, b]" represents the Huffman encoded relative representation level of the ILD for frame f and bin b.

It should be noted that the above-mentioned embodiments illustrate rather than limit the invention, and that those skilled in the art will be able to design many alternative embodiments without departing from the scope of the appended claims.

Although the invention is elucidated in the Figs. with respect to a stereo signal, the extension to a more than two channel audio signal can easily be accomplished by the skilled person.

In the claims, any reference signs placed between parentheses shall not be construed as limiting the claim. The word "comprising" does not exclude the presence of elements or steps other than those listed in a claim. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

In summary, multi-channel audio signals are coded into a monaural audio signal and information allowing to recover the multi-channel audio signal from the monaural audio signal and the information. The information is generated by determining a first portion of the information for a first frequency region of the multi-channel audio signal, and by determining a second portion of the information for a second frequency region of the multi-channel audio signal. The second frequency region is a portion of the first frequency region and thus is a sub-range of the first frequency region. The information is multi-layered enabling a scaling of the decoding quality versus bit rate.

The invention claimed is:

1. A method of encoding a multi-channel audio signal comprising at least two audio channels, the method comprising the steps of:

generating a single channel audio signal from the at least two audio channels, and encoding, using an encoder, the single channel audio signal into a bit stream as an encoded single channel audio signal;

generating information from the at least two audio channels allowing to recover with a required quality level the multi-channel audio signal from the single channel audio signal and the information; and combining the information and the single channel audio signal, wherein the generating information step comprises the steps of:

determining a first portion of the information for a first frequency region of the multi-channel audio signal using a parameter determining circuit;

encoding, using a parameter coder, the first portion of the information into the bit stream as an encoded first portion of the information;

determining a second portion of the information for a second frequency region of the multi-channel audio signal using the parameter determining circuit, the second frequency region being a portion of the first frequency region; and encoding, using the parameter coder, the second portion of the information into the bit stream as an encoded second portion of the information, wherein the second portion is differentially coded with respect to the first portion.

2. The method of encoding a multi-channel audio signal as claimed in claim 1, wherein the method further comprises the steps of:

receiving a maximum allowable bit rate of the encoded multi-channel audio signal; and determining and encoding the second portion of the information for the second frequency region of the multi-channel audio signal if a bit rate of the encoded multi-channel audio signal comprising the single channel audio signal and the first and second portions of the information is not higher than the maximum allowable bit rate.

3. The method of encoding as claimed in claim 1, wherein the single channel audio signal is a particular combination of the at least two audio channels.

4. The method of encoding as claimed in claim 1, characterized in that the information comprises sets of parameters, the first portion comprises at least a first one of the sets of parameters, the second portion comprises at least a second one of the sets of parameters, wherein each set of parameters is associated with a corresponding frequency region.

5. The method of encoding as claimed in claim 4, characterized in that the sets of parameters comprise at least one localization cue.

6. The method of encoding as claimed in claim 5, characterized in that the at least one localization cue is selected from: an interaural level difference, an interaural time or phase difference, or an interaural cross-correlation.

7. The method of encoding as claimed in claim 1, characterized in that the first frequency region covers a full bandwidth of the multi-channel audio signal.

8. The method of encoding as claimed in claim 4, characterized in that the determining of the first portion of information in a particular frame of encoded information comprises determining the first one of the sets of parameters in the particular frame, and coding the first one of the sets of parameters based on the first one of the sets of parameters of a frame preceding the particular frame.

9. The method of encoding as claimed in claim 8, characterized in that the determining comprises calculating a difference between the corresponding parameters in the particular frame and the frame preceding the particular frame.

10. A method of encoding a multi-channel audio signal comprising at least two audio channels, the method comprising the steps of:

generating a single channel audio signal from the at least two audio channels, and encoding, using an encoder, the single channel audio signal into a bit stream as an encoded single channel audio signal;

generating information from the at least two audio channels allowing to recover with a required quality level the multi-channel audio signal from the single channel audio signal and the information; and combining the information and the encoded single channel audio signal, wherein the generating information step comprises the steps of:

determining a first portion of the information for a first frequency region of the multi-channel audio signal using a parameter determining circuit;

encoding, using a parameter coder, the first portion of the information into the bit stream as an encoded first portion of the information;

determining a second portion of the information for a second frequency region of the multi-channel audio signal using the parameter determining circuit, the second frequency region being a portion of the first frequency region; and encoding, using the parameter coder, the second portion of the information into the bit stream as an encoded second portion of the information, characterized in that the first frequency region substantially covers a full bandwidth of the multi-channel audio signal, the second frequency region covers a portion of the full bandwidth, and in that the determining of the second portion of the information is adapted to determine sets of parameters for both the second frequency region and a set of further frequency regions, the second frequency region and the set of further frequency regions substantially covering the full bandwidth, wherein the set of further frequency regions comprises at least one further frequency region.

11. The method of encoding as claimed in claim 10, characterized in that the single channel audio signal and the first portion of the information form a base layer of information which is always present in the encoded multi-channel audio signal, and in that the method comprises receiving a maximum allowable bit rate of the encoded multi-channel audio signal, the second portion of the information forming an enhancement layer of information which is encoded only if the bit rate of the encoded base layer and enhancement layer is not higher than the maximum allowable bit rate.

12. The method of encoding as claimed in claim 10, characterized in that the determining of the second portion of information in a particular frame of the encoded information comprises determining the sets of parameters of the second portion in the particular frame and coding the sets of parameters of the second portion in the particular frame based on the sets of parameters of a frame preceding the particular frame.

13. The method of encoding as claimed in claim 10, characterized in that the determining of the second portion of information in a particular frame of the encoded information comprises determining the sets of parameters of the second portion in the particular frame and coding the sets of parameters of the second portion in the particular frame based on the first one of the sets of parameters of a frame preceding the particular frame.

14. An encoder for coding a multi-channel audio signal comprising at least two audio channels, the encoder comprising:

a downmixer for generating a single channel audio signal from the at least two audio channels, and an encoder for encoding the single channel audio signal into a bit stream as an encoded single channel audio signal;

a parameter determining circuit for generating information from the at least two audio channels, and a parameter encoder for encoding the information, said information allowing to recover, with a required quality level, the multi-channel audio signal from the single channel audio signal and the information; and a formatter for combining the information into the bit stream of the encoded single channel audio signal, wherein the parameter determining circuit:

determines a first portion of the information for a first frequency region of the multi-channel audio signal, and encodes the first portion of the information into the bit stream as an encoded first portion of the information, and determines a second portion of the information for a second frequency region of the multi-channel audio signal, the second frequency region being a portion of the first frequency region, and encodes the second portion of the information into the bit stream as an encoded second portion of the information, wherein the second portion is differentially coded with respect to the first portion.

15. The encoder for encoding a multi-channel audio signal as claimed in claim 14, wherein the encoder further comprises:

an input for receiving a maximum allowable bit rate of the encoded multi-channel audio signal, and wherein said parameter determining circuit only determines and encodes said second portion if a bit rate of the encoded multi-channel audio signal comprising the single channel audio signal and the first and second portions of the information is not higher than the maximum allowable bit rate.

16. An apparatus for supplying an audio signal, the apparatus comprising:

an input for receiving an audio signal;

an encoder as claimed in claim 14 for encoding the audio signal to obtain an encoded audio signal; and an output for supplying the encoded audio signal.

* * * * *